US010644450B2

(12) United States Patent
Su

(10) Patent No.: US 10,644,450 B2
(45) Date of Patent: May 5, 2020

(54) ELECTRICAL WIRE MANAGEMENT DEVICE AND METHOD FOR MANAGING ELECTRICAL WIRE

(71) Applicant: NEXTRONICS ENGINEERING CORP., New Taipei (TW)

(72) Inventor: Hou-An Su, Keelung (TW)

(73) Assignee: NEXTRONICS ENGINEERING CORP., New Taipei (TW)

( * ) Notice: Subject to any disclaimer, the term of this patent is extended or adjusted under 35 U.S.C. 154(b) by 0 days.

(21) Appl. No.: 16/432,489

(22) Filed: Jun. 5, 2019

(65) Prior Publication Data

US 2019/0379163 A1 Dec. 12, 2019

(30) Foreign Application Priority Data

Jun. 6, 2018 (TW) ..... 107119479 A

(51) Int. Cl.
*H01R 13/639* (2006.01)
*H01R 13/17* (2006.01)

(52) U.S. Cl.
CPC ..... *H01R 13/639* (2013.01); *H01R 13/17* (2013.01)

(58) Field of Classification Search
CPC .... H01R 2107/00; H01R 24/38; H01R 24/58; H01R 24/86; H01R 13/187; H01R 13/516; H01R 13/5804
See application file for complete search history.

(56) References Cited

U.S. PATENT DOCUMENTS

| | | | | |
|---|---|---|---|---|
| 3,980,380 | A * | 9/1976 | Cieniawa | H01R 4/2429 439/404 |
| 4,106,839 | A * | 8/1978 | Cooper | H01R 13/6583 439/607.18 |
| 10,186,802 | B1 * | 1/2019 | Chen | H01R 13/20 |
| 10,312,620 | B1 * | 6/2019 | Su | H01R 13/187 |
| 10,340,644 | B1 * | 7/2019 | Lee | H01R 12/716 |
| 10,431,944 | B1 * | 10/2019 | Su | H01R 13/631 |
| 2010/0291802 | A1 * | 11/2010 | Sawai | H01R 13/5224 439/660 |
| 2014/0120741 | A1 * | 5/2014 | Borg | H01R 39/64 439/13 |
| 2019/0067855 | A1 * | 2/2019 | Su | H01R 12/777 |
| 2019/0166924 | A1 * | 6/2019 | Komoto | A41D 1/005 |

* cited by examiner

*Primary Examiner* — Oscar C Jimenez
(74) *Attorney, Agent, or Firm* — Li & Cai Intellectual Property (USA) Office

(57) ABSTRACT

An electrical wire management device includes a spring connector and an electrical wire assembly. The spring connector includes an insulating body and a plurality of spring terminals. The insulating body is arc-shaped, a side of the insulating body forms an opening, and the spring terminals are disposed on the insulating body. Each spring terminal has a contact portion and a pin portion. The contact portions of the spring terminals respectively extend into a plurality of wire grooves of the insulating body. The electrical wire assembly includes a plurality of electrical wires, and an end of each electrical wire has a connection portion. The connection portions of the electrical wires are respectively disposed into the wire grooves, the contact portions of the spring terminals respectively clamp the connection portions of the electrical wires, such that the electrical wires are electrically connected to the spring terminals.

12 Claims, 12 Drawing Sheets

ELECTRICAL WIRE MANAGEMENT DEVICE AND METHOD FOR MANAGING ELECTRICAL WIRE

CROSS-REFERENCE TO RELATED PATENT APPLICATION

This application claims the benefit of priority to Taiwan Patent Application No. 107119479, filed on Jun. 6, 2018. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an electrical wire management device and a method for managing electrical wire, and more particularly to an electrical wire management device and a method for managing electrical wire that can be used to manage an electrical wire assembly grouped with a large number of electrical wires each having a small wire diameter.

BACKGROUND OF THE DISCLOSURE

Conventional connectors are a type of connecting device that electrically connects electrical wires (cables), circuit boards, and other circuit components. These connectors have been widely used in various electronic products in our lives. The conventional connectors can be used in the field of medical devices. Since some medical devices are upgraded with new technologies and new functions, the connectors would relatively require more signal transmission points to satisfy the needs of these upgraded medical devices. Further, in order to avoid an increase in size of some portable devices, the sizes of the corresponding connectors and electrical wires have to be miniaturized. Therefore, the terminals and electrical wires of the connectors become difficult to be soldered together, and problems such as wire breakage may occur during soldering. If an insulation displacement contact (IDC) terminal is used, there would also be a size limitation, which makes it difficult to apply to an electrical wire having a small wire diameter (less than the wire diameter of the AWG 40 wire). Moreover, most electrical wire assemblies are also not convenient to manage.

SUMMARY OF THE DISCLOSURE

In response to the above-referenced technical inadequacies, the present disclosure provides an electrical wire management device and a method for managing electrical wire that can be used to manage an electrical wire assembly grouped with a large number of electrical wires each having a small wire diameter, which solves problems such as wire breakage and difficulty in soldering, and is convenient to manage the electrical wires of the electrical wire assembly.

In one aspect, the present disclosure provides an electrical wire management device including an electrical wire assembly and a spring connector. The electrical wire assembly includes a plurality of electrical wires, and an end of each of the electrical wires has a connection portion. The spring connector includes an insulating body and a plurality of spring terminals. The insulating body is in an arc shape, a side of the insulating body forms an opening, the insulating body has a plurality of wire grooves spaced apart from each other, and the spring terminals are disposed on the insulating body. Each of the spring terminals has a contact portion and a pin portion. The contact portion extends in a spiral shape, the contact portion forms a gap, and the pin portion is connected to the contact portion. The contact portions of the spring terminals respectively extend into the wire grooves. The connection portions of the electrical wires are respectively disposed into the wire grooves of the insulating body, the contact portions of the spring terminals are configured to respectively clamp the connection portions of the electrical wires, and the connection portions of the electrical wires are respectively clamped in the gaps of the contact portions of the spring terminals, such that the electrical wires are respectively and electrically connected to the spring terminals, and the electrical wire assembly is capable of being managed or organized via the opening of the insulating body.

In one aspect, the present disclosure also provides an electrical wire management device including: a housing, a plurality of spring connectors, an electrical connector, a plurality of electrical wire assemblies and a plurality of circuit boards. The spring connectors are stacked on each other and disposed in the housing. Each of the spring connectors includes an insulating body and a plurality of spring terminals, the insulating body is in an arc shape, a side of the insulating body forms an opening, the insulating body has a plurality of wire grooves spaced apart from each other, and the spring terminals are disposed on the insulating body. Each of the spring terminals has a contact portion and a pin portion. The contact portion extends in a spiral shape, the contact portion forms a gap, and the pin portion is connected to the contact portion. In each of the spring connectors, the contact portions of the spring terminals respectively extend into the wire grooves. The electrical connector is disposed in the housing. Each of the electrical wire assemblies includes a plurality of electrical wires, and an end of each of the electrical wires has a connection portion. The connection portions of the electrical wires of the electrical wire assemblies are respectively disposed into the wire grooves of the insulating bodies of the spring connectors, the contact portions of the spring terminals are configured to respectively clamp the connection portions of the electrical wires, and the connection portions of the electrical wires are respectively clamped in the gaps of the contact portions of the spring terminals, such that the electrical wires are respectively and electrically connected to the spring terminals. The circuit boards are disposed in the housing. The pin portions of the spring terminals are respectively and electrically connected to the circuit boards, the circuit boards are electrically connected to the electrical connector, such that the electrical wires of the electrical wire assemblies are capable of being electrically connected to the circuit boards and the electrical connector through the spring terminals of the spring connectors, and the electrical wire assemblies are capable of being managed or organized via the openings of the insulating bodies.

In one aspect, the present disclosure also provides a method for managing electrical wire, which includes steps of: providing an electrical wire assembly and a spring connector, in which the electrical wire assembly includes a plurality of electrical wires, and an end of each of the electrical wires has a connection portion, in which the spring connector includes an insulating body and a plurality of spring terminals, the insulating body is in an arc shape, a side of the insulating body forms an opening, the insulating body has a plurality of wire grooves spaced apart from each other, and the spring terminals are disposed on the insulating body, in which each of the spring terminals has a contact portion and a pin portion, the contact portion extends in a spiral shape, the contact portion forms a gap, and the pin portion is connected to the contact portion, and in which the contact portions of the spring terminals respectively extend into the wire grooves; respectively putting the connection portions of the electrical wires into the wire grooves of the insulating body; and respectively clamping the connection portions of the electrical wires through the contact portions of the spring terminals to enable the connection portions of the electrical wires to be respectively clamped in the gaps of the contact portions of the spring terminals, such that the electrical wires are respectively and electrically connected to the spring terminals, and the electrical wire assembly are capable being managed or organized via the opening of the insulating body.

Therefore, the spring connector of the present disclosure includes an insulating body and a plurality of spring terminals. The connection portions of the electrical wires are respectively disposed into the wire grooves of the insulating body, the contact portions of the spring terminals are configured to respectively clamp the connection portions of the electrical wires, and the connection portions of the electrical wires are respectively clamped in the gaps of the contact portions of the spring terminals, such that the electrical wires are respectively and electrically connected to the spring terminals. The spring connector can be used to clamp electrical wires having small wire diameters without causing problems such as wire breakage and difficulty in soldering. The insulating body is in an arc shape, and a side of the insulating body forms an opening. The electrical wire assembly can freely pass through the opening of the insulating body to facilitate management of the electrical wires. Moreover, the insulating bodies are capable of being stacked on each other to layer and fix the electrical wires of the electrical wire assemblies. Meanwhile, the electrical wires located at each layer can pass through any other layer of the insulating bodies through the openings of the insulating bodies.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The present disclosure will become more fully understood from the following detailed description and accompanying drawings.

DETAILED DESCRIPTION OF THE EXEMPLARY EMBODIMENTS

Figure 1:
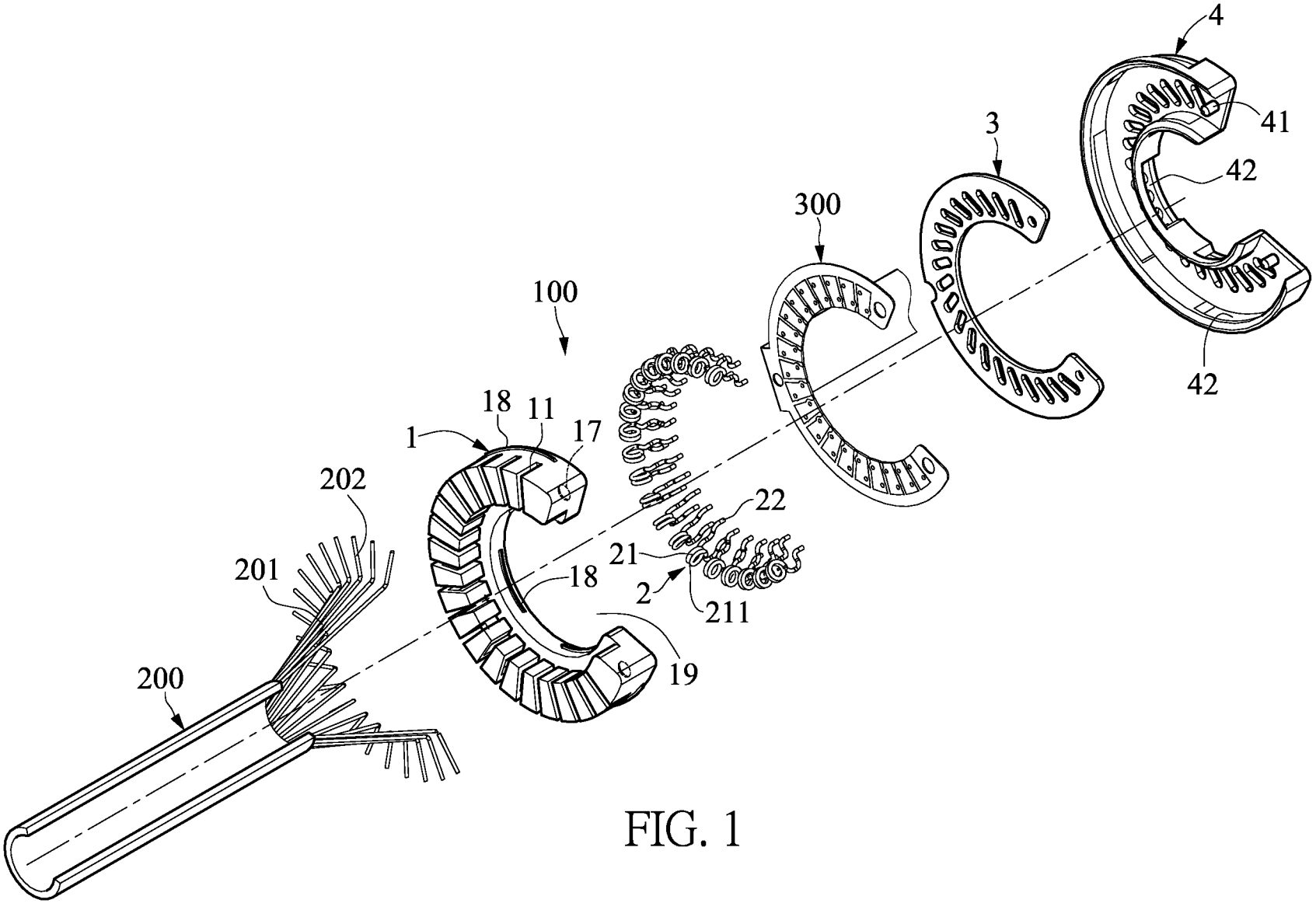
FIG. 1 is an exploded view showing an electrical wire management device according to a first embodiment of the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way. Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

First Embodiment

Figure 2:
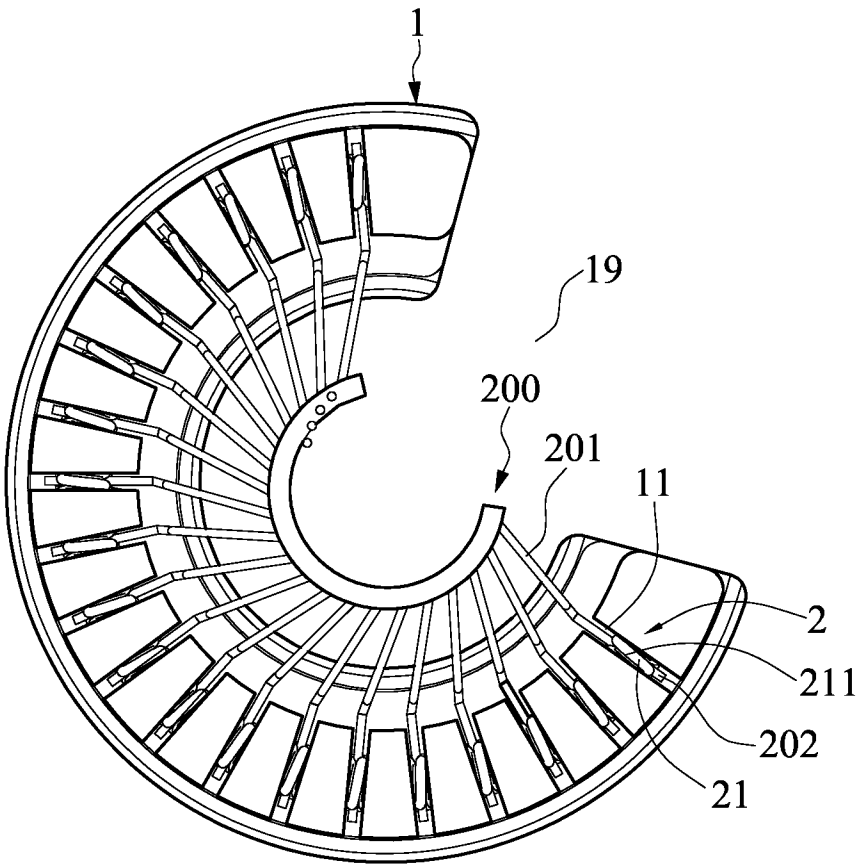
FIG. 2 is a side view showing the electrical wire management device according to the first embodiment of the present disclosure.
Figure 3:
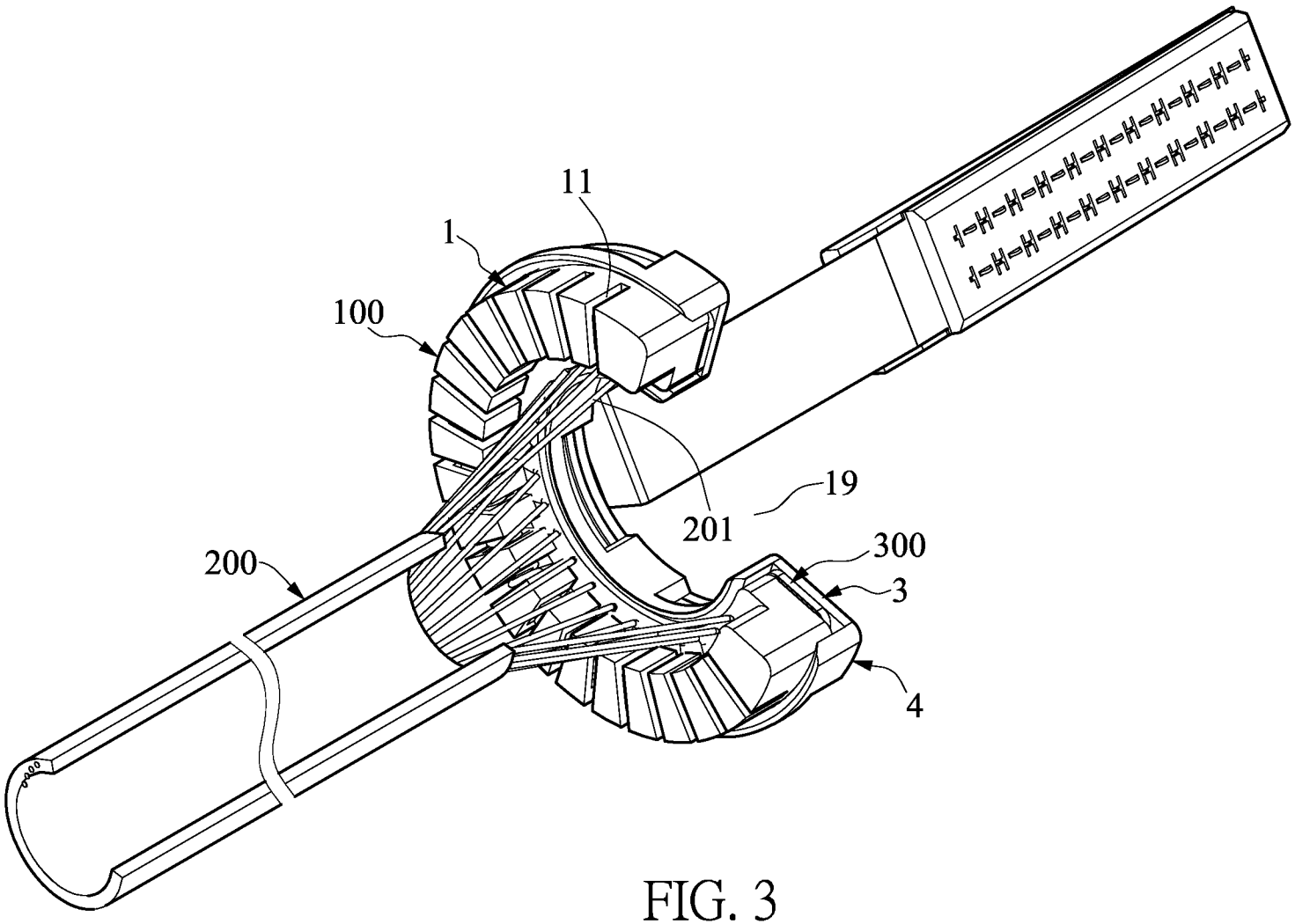
FIG. 3 is a perspective view showing the electrical wire management device according to the first embodiment of the present disclosure.

Referring to FIG. 1 to FIG. 3, a first embodiment of the present disclosure provides an electrical wire management device. The electrical wire management device can be disposed in various connecting devices. The connecting device may be a plug connecting device or a socket connecting device or the like, and the configuration of the connecting device is not limited.

The electrical wire management device includes a spring connector 100 and an electrical wire assembly 200. The electrical wire assembly 200 includes a plurality of electrical wires 201, and an end of each of the electrical wires 201 has a connection portion 202. That is, an insulating outer layer located at the end of each of the electrical wires 201 can be removed to expose an inner conductor located at the end of each of the electrical wires 201 so as to form the connection portion 202. Preferably, a wire diameter of each of the connection portions 202 is less than 0.10 mm, but the present disclosure is not limited thereto.

Figure 4:
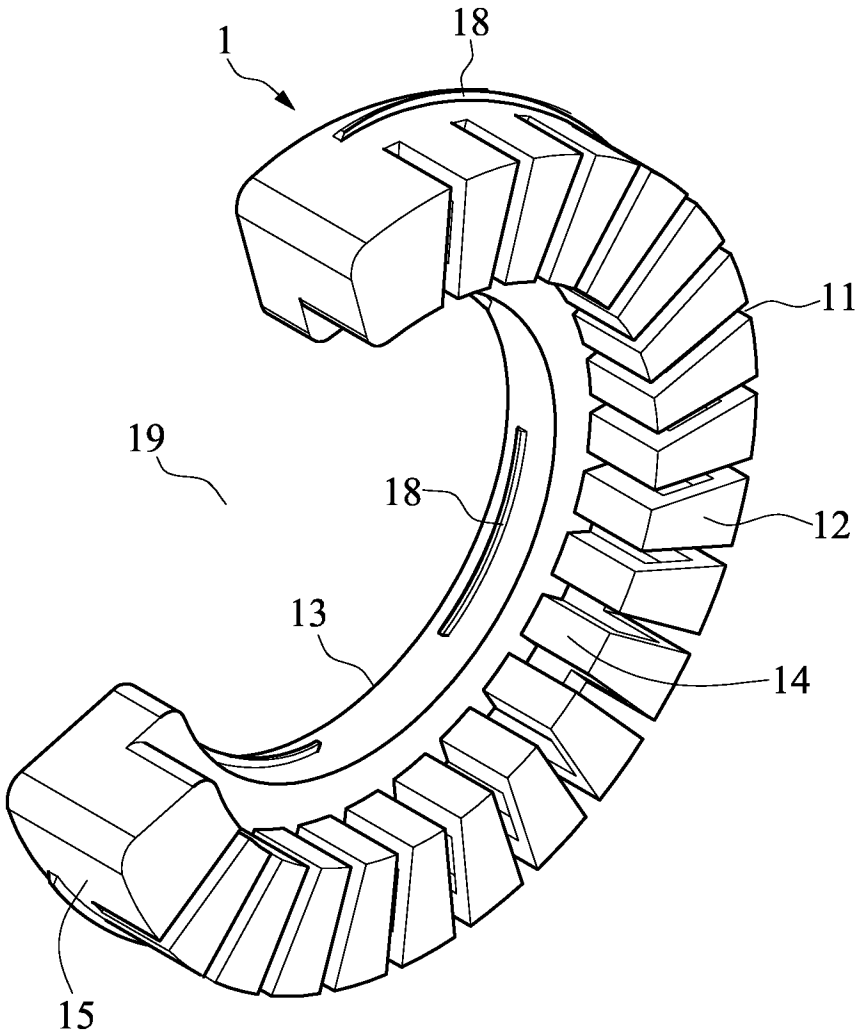
FIG. 4 is a perspective view showing an insulating body according to the first embodiment of the present disclosure.
Figure 5:
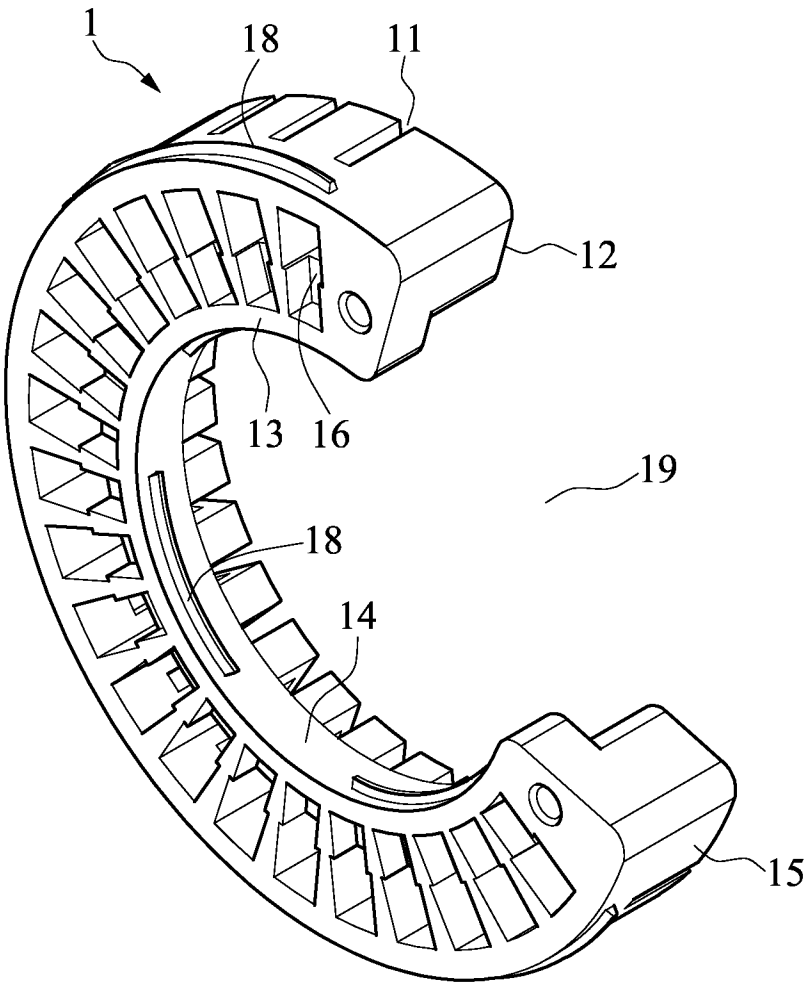
FIG. 5 is another perspective view showing the insulating body according to the first embodiment of the present disclosure.

The spring connector 100 includes an insulating body 1 and a plurality of spring terminals 2. The insulating body 1 may be made of an insulating material such as plastic, and the material and configuration of the insulating body 1 are not limited. In the present embodiment, the insulating body 1 has a plurality of wire grooves 11 spaced apart from each other. Referring to FIG. 4 to FIG. 5, the insulating body 1 has a first end face 12, a second end face 13, an inner face 14 and an outer face 15. The first end face 12 and the second end face 13 are respectively two opposite faces of the insulating body 1. The inner face 14 and the outer face 15 are respectively located on an inner side and an outer side of the insulating body 1. The wire grooves 11 are arranged in a ring shape around an axial direction of the insulating body 1 and extend along a radius direction of the insulating body 1. The wire grooves 11 are respectively recessed from the first end face 12 of the insulating body 1, and extend through the inner face 14 and the outer face 15 of the insulating body 1, such that the connection portions 202 of the electrical wires 201 are capable of being disposed into the wire grooves 11, respectively. In addition, the insulating body 1 further has a plurality of terminal grooves 16 spaced apart from each other. The terminal grooves 16 are respectively in spatial communication with the wire grooves 11, and the terminal grooves 16 are respectively recessed from the second end face 13 of the insulating body 1.

The insulating body 1 is in a C-shape. That is, the insulating body 1 is in an arc shape, and two ends of the insulating body 1 are not connected to each other, such that a side of the insulating body 1 forms an opening 19. The opening 19 extends through the first end face 12 and the second end face 13 of the insulating body 1, and the inner face 14 of the insulating body 1 surrounds the opening 19, such that the electrical wire assembly 200 is capable of freely entering or exiting a center portion of the insulating body 1 through the opening 19.

The spring terminals 2 may be made of a metal material having good electrical conductivity or an alloy material thereof (i.e. phosphorus copper alloy), and the present disclosure is not limited thereto. The number of the spring terminals 2 is not limited and can be changed according to actual needs. The spring terminals 2 are disposed on the insulating body 1, and the spring terminals 2 are capable of being accommodated in the terminal grooves 16, respectively. Each of the spring terminals 2 is formed by bending a metal wire having a wire diameter of 0.1 mm to 0.3 mm, but the present disclosure is not limited thereto.

Each of the spring terminals 2 has a contact portion 21 and at least a pin portion 22. More specifically, in each of the spring terminals 2, the contact portion 21 extends in a spiral shape to form a spring structure, and the contact portion 21 forms a gap 211. The pin portion 22 is electrically connected to the contact portion 21. The number of the pin portion 22 may be one or two so as to be connected to one end or two ends of the contact portion 21. The contact portions 21 of the spring terminals 2 respectively extend into the wire grooves 11. The pin portions 22 of the spring terminals 2 can be electrically connected to a device such as a circuit board 300 by soldering or the like. In the present embodiment, the circuit board 300 is a flexible circuit board, but the present disclosure is not limited thereto.

The spring connector 100 further includes a cover plate 3 and a support plate 4. The cover plate 3 and the support plate 4 each is a plate body having a C-shape or an arc-shape corresponding to the insulating body 1. The cover plate 3 is covered on the insulating body 1. That is, the cover plate 3 is covered on the second end face 13 of the insulating body 1 for closing the terminal grooves 16, such that the spring terminals 2 can be stably disposed in the terminal grooves 16, and the circuit board 300 can be sandwiched between the cover plate 3 and the insulating body 1. The support plate 4 is covered on a face of the cover plate 3 away from the insulating body 1. The support plate 4 is provided with a plurality of fixing posts 41, and the fixing posts 41 sequentially pass through the cover plate 3 and the circuit board 300. The insulating body 1 further has a plurality of fixing holes 17, and the fixing posts 41 are fixedly inserted into the fixing holes 17, respectively. Therefore, the insulating body 1, the circuit board 300, the cover plate 3 and the support plate 4 can be firmly assembled together. The inner side and the outer side of the insulating body 1 are respectively provided with a plurality of first hooking portions 18. The support plate 4 forms a hollow portion (not labeled), and the support plate 4 is provided with a plurality of second hooking portions 42 on the inner side and the outer side of the hollow portion. The first hooking portions 18 are respectively hooked to the second hooking portions 42, such that the insulating body 1, the circuit board 300, the cover plate 3 and the support plate 4 can be assembled together more firmly.

The connection portions 202 of the electrical wires 201 are capable of being disposed into the wire grooves 11 of the insulating body 1, respectively. The contact portions 21 of the spring terminals 2 are capable of clamping the connection portions 202 of the electrical wires 201, respectively. That is, the connection portions 202 of the electrical wires 201 are capable of being clamped in the gaps 211 of the contact portions 21 of the spring terminals 2, respectively. The spring structure of each of the spring terminals 2 has a pre-stress for firmly clamping the connection portion 202 of the corresponding electrical wire 201, such that the electrical wires 201 are capable of being electrically connected to the spring terminals 2, respectively. The electrical wires 201 are capable of being electrically connected to the circuit board 300 through the spring terminals 2, respectively. Therefore, the electrical wire management device of the present embodiment can be used to clamp electrical wires having small wire diameters without causing a problem of wire breakage. The insulating body 1 is in an arc shape, a side of the insulating body 1 forms an opening 19, and the electrical wire assembly 200 can freely pass through the opening 19 of the insulating body 1 to facilitate management of the electrical wires 201. The side of the insulating body 1 of the spring connector 100 has the opening 19, so that the electrical wires 201 of the electrical wire assembly 200 can be separated and lined at the center portion of the insulating body 1, such that the electrical wires 201 are radially arranged with equal lengths. Moreover, since the electrical wires 201 can pass through the center portion of the insulating body 1, the insulating body 1 can be stacked on other ones of the insulating body 1 to achieve a manner in which a plurality of insulating bodies 1 are stacked on each other.

Figure 6:
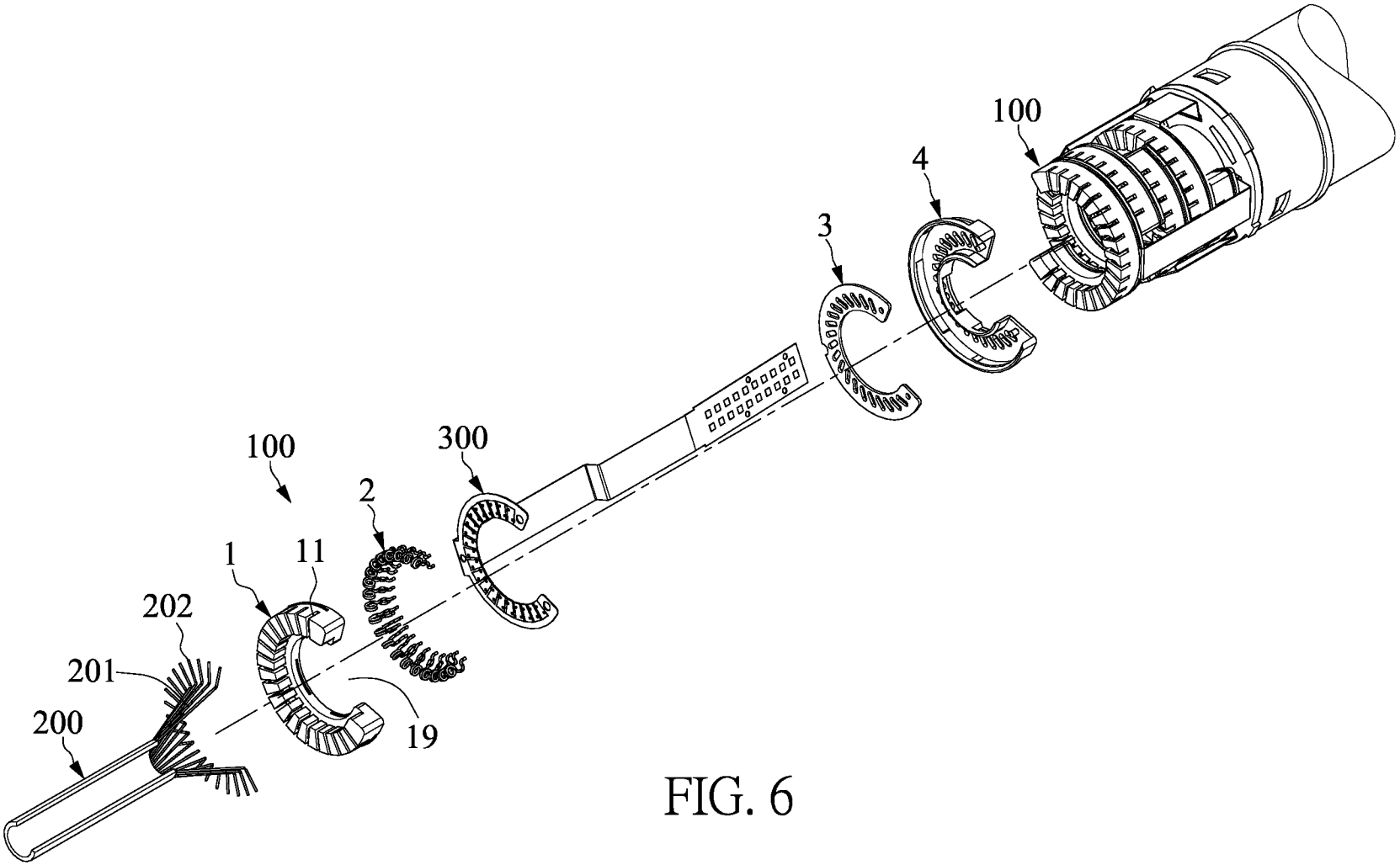
FIG. 6 is a perspective view showing a plurality of spring connectors stacked on each other.

Referring to FIG. 6, in practical application of the spring connector 100 of the present embodiment, a plurality of spring connectors 100 can be stacked on each other to form a connecting device having a high density of contacts.

Figure 11:
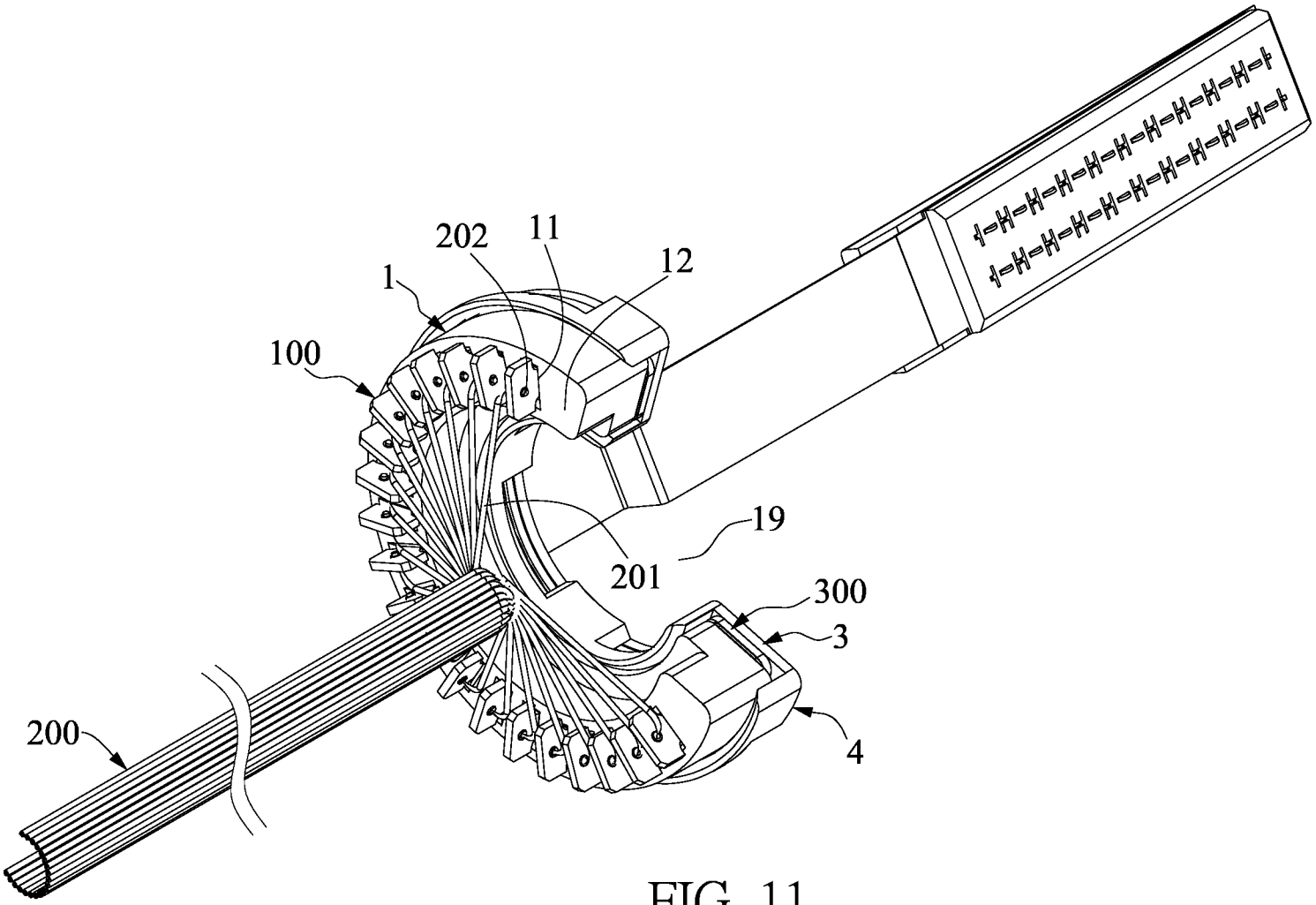
FIG. 11 is a perspective view showing an electrical wire management device according to a variant embodiment of the first embodiment.
Figure 12:
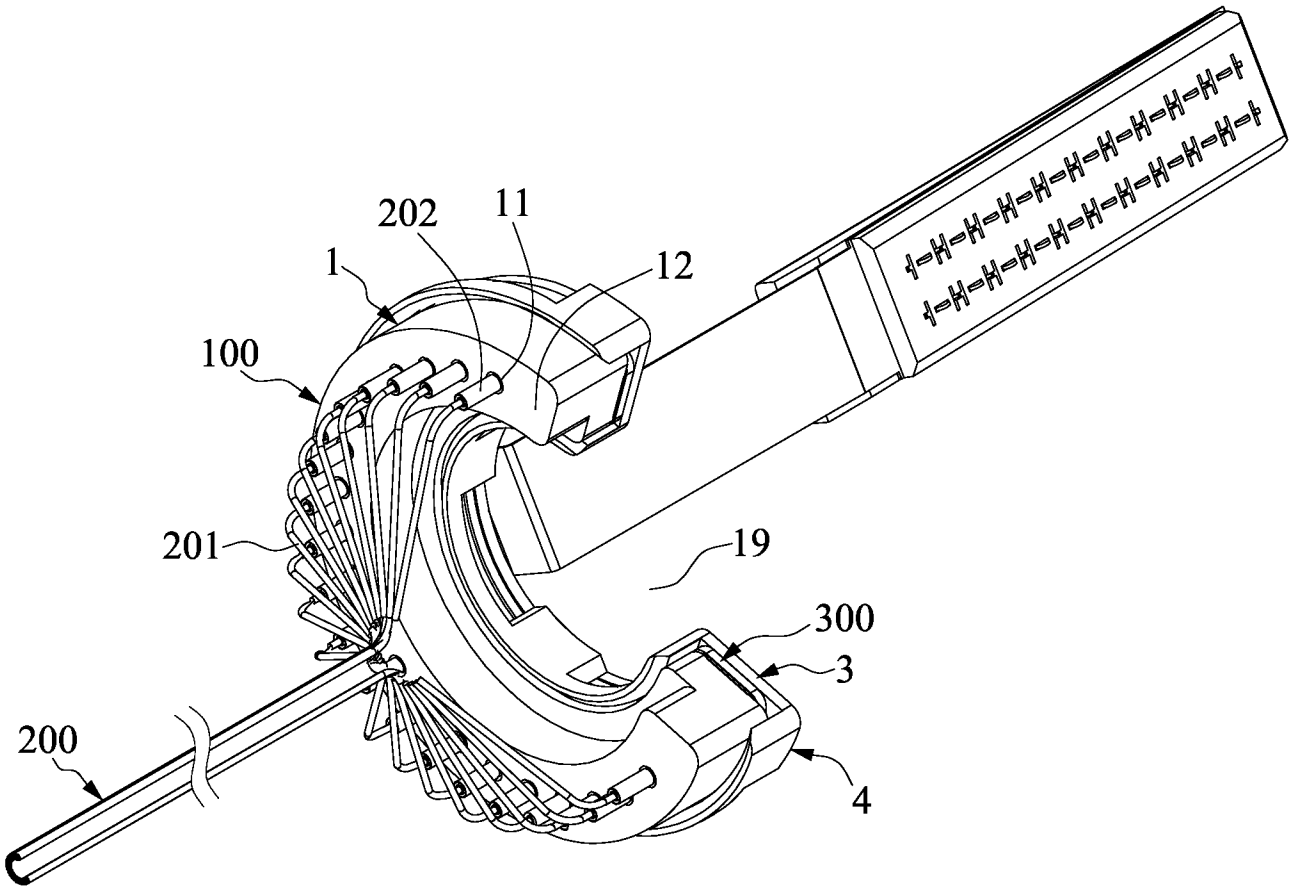
FIG. 12 is a perspective view showing an electrical wire management device according to another variant embodiment of the first embodiment.

Referring to FIG. 11 and FIG. 12, in variant embodiments of the present embodiment, the insulating body 1 has a plurality of wire grooves 11 spaced apart from each other, the wire grooves 11 may be in the form of square holes (as shown in FIG. 11) or circular holes (as shown in FIG. 12), the wire grooves 11 may be arranged in a ring shape around an axial direction of the insulating body 1, the wire grooves 11 are recessed from the first end face 12 of the insulating body 1, and the wire grooves 11 are respectively in spatial communication with the terminal grooves 16 as shown in FIG. 5. Moreover, an end of each of the electrical wires 201 has a connection portion 202, and the connection portion 202 may be in the form of a sheet (as shown in FIG. 11) or a pin (as shown in FIG. 12). The connection portions 202 of the electrical wires 201 are capable of being respectively disposed into the wire grooves 11 of the insulating body 1, and the contact portions 21 of the spring terminals 2 are capable of clamping the connection portions 202 of the electrical wires 201, respectively. That is, the connection portions 202 of the electrical wires 201 are capable of being clamped in the gaps 211 of the contact portions 21 of the spring terminals 2, respectively. Moreover, the connection portion 202 of each of the electrical wires 201 and the contact portion 21 of the corresponding spring terminal 2 are configured to form four contact points therebetween, such that the electrical wires 201 are capable of being electrically connected to the spring terminals 2, respectively.

Second Embodiment

Figure 7:
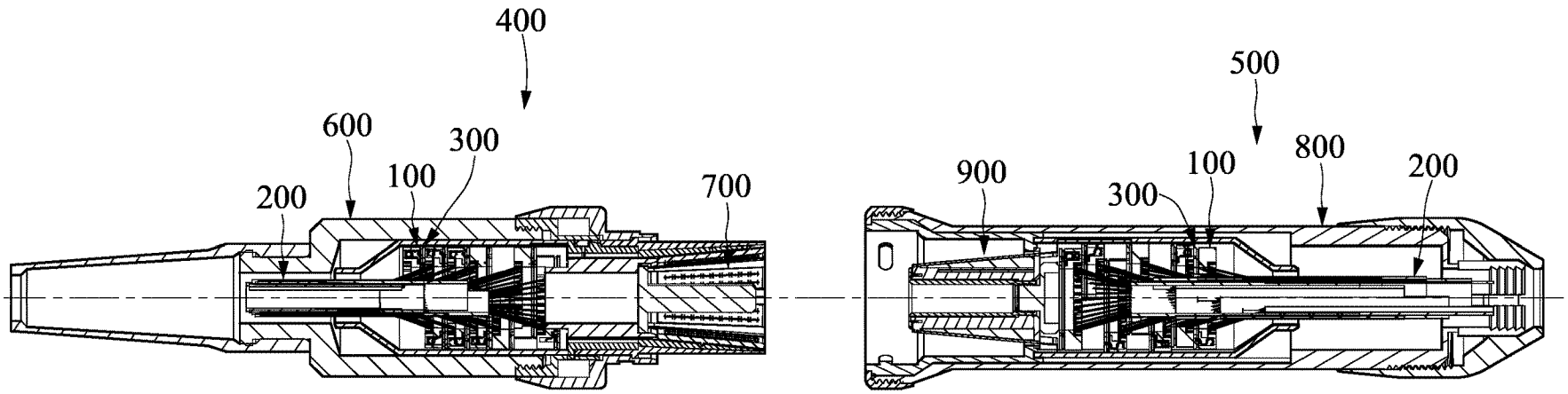
FIG. 7 is a cross-sectional view showing a first connecting device and a second connecting device according to a second embodiment of the present disclosure.
Figure 8:
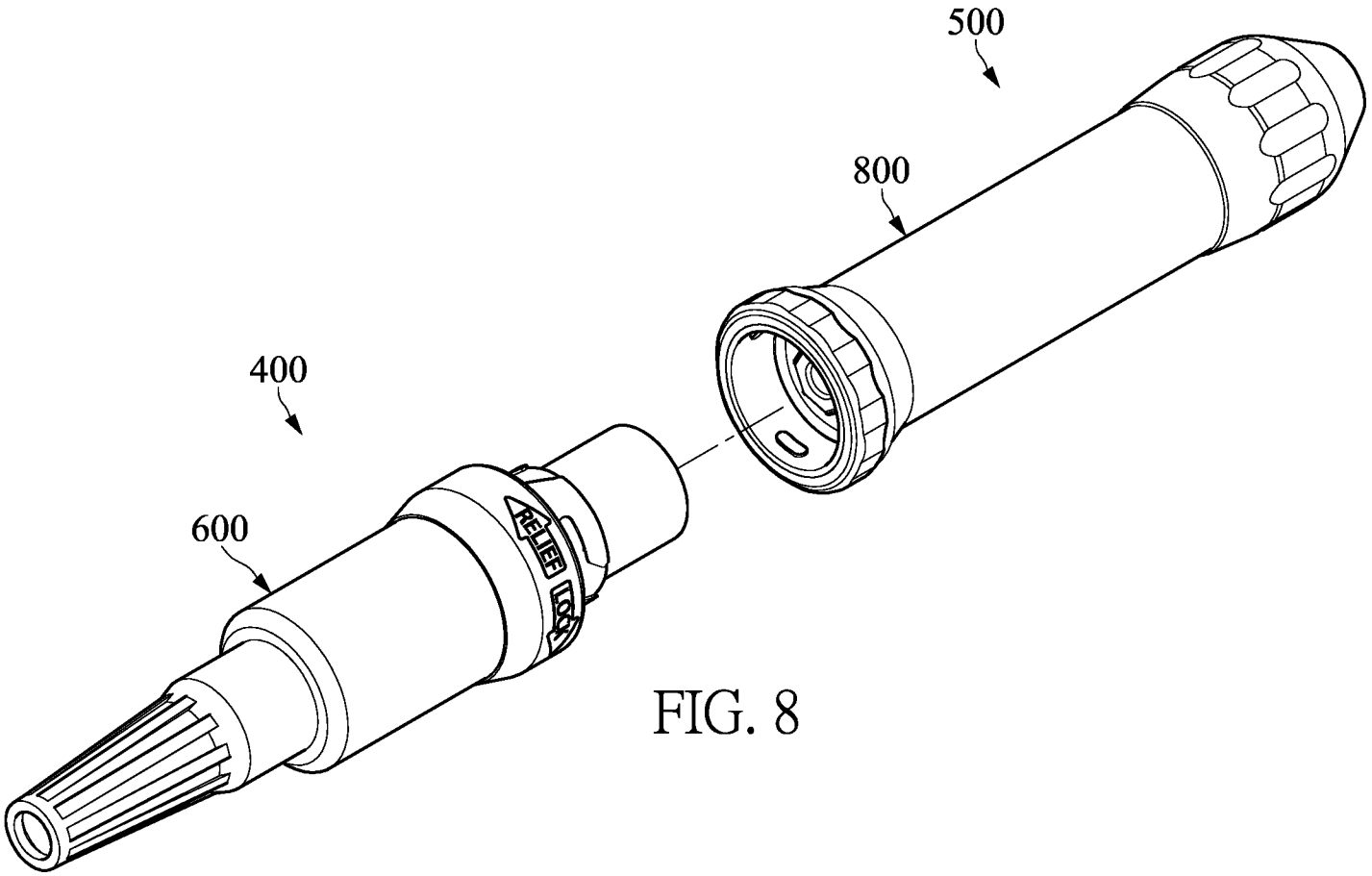
FIG. 8 is a perspective view showing the first connecting device and the second connecting device according to the second embodiment of the present disclosure.

Referring to FIG. 7 and FIG. 8, a second embodiment of the present disclosure provides a first connecting device (electrical wire management device) 400 and a second connecting device (electrical wire management device) 500. The first connecting device 400 and the second connecting device 500 are a corresponding plug connecting device and a corresponding socket connecting device, respectively.

Figure 9:
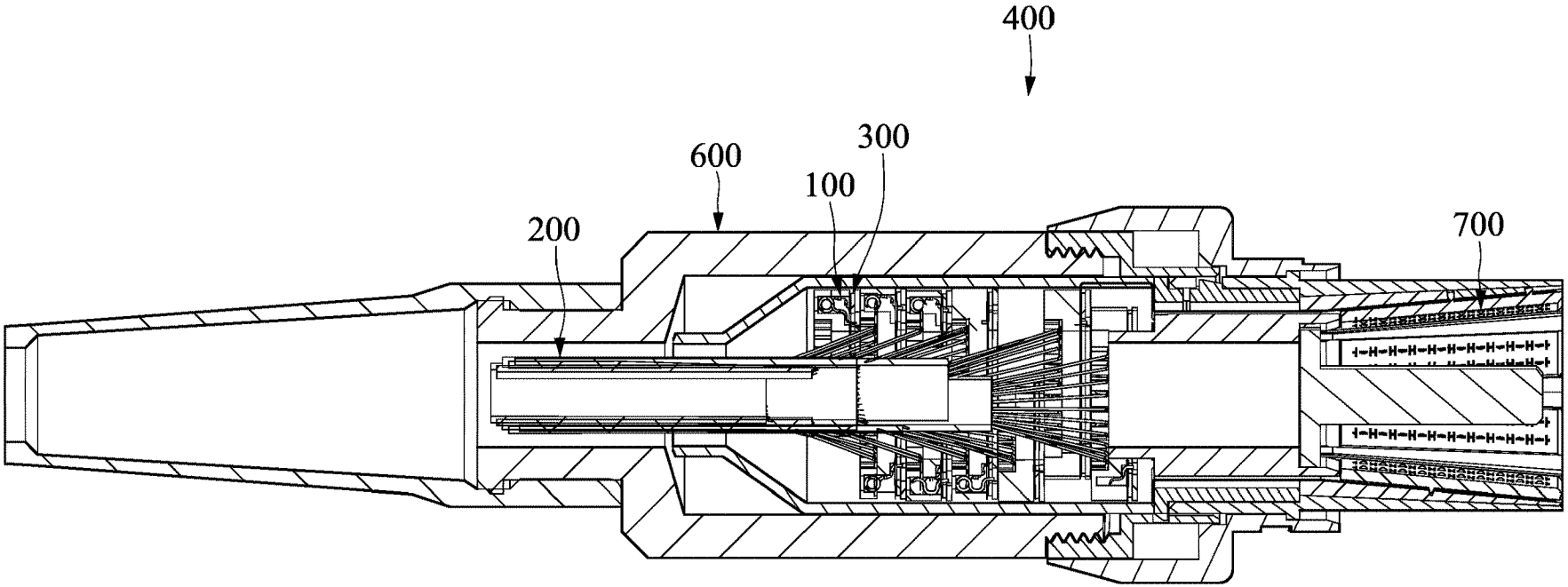
FIG. 9 is a cross-sectional view showing the first connecting device according to the second embodiment of the present disclosure.

Referring to FIG. 9, which is to be read in conjunction with FIG. 1 and FIG. 2, the first connecting device (connecting device) 400 includes a first housing (housing) 600, a plurality of spring connectors 100, a first electrical connector (electrical connector) 700, a plurality of electrical wire assemblies 200 and a plurality of circuit boards 300. The spring connectors 100 of the first connecting device 400 are stacked on each other and disposed in the first housing 600. The circuit boards 300 and the first electrical connector 700 of the first connecting device 400 are disposed in the first housing 600, and the circuit boards 300 are electrically connected to the first electrical connector 700, such that the electrical wires 201 of the electrical wire assemblies 200 are capable of being electrically connected to the circuit boards 300 and the first electrical connector 700 through the spring terminals 2 of the spring connectors 100. The configuration of the first electrical connector 700 is not limited, and will not be reiterated herein.

Figure 10:
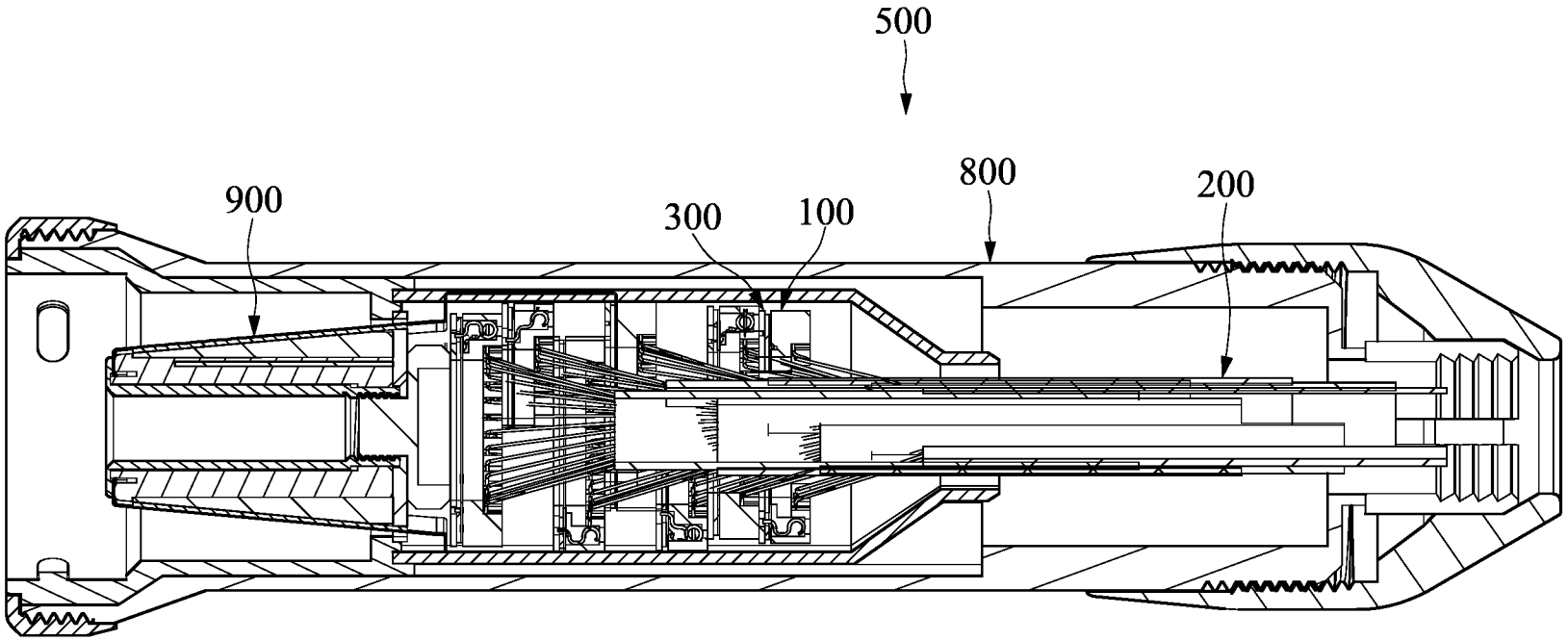
FIG. 10 is a cross-sectional view showing the second connecting device according to the second embodiment of the present disclosure.

Referring to FIG. 10, which is to be read in conjunction with FIG. 1 and FIG. 2, the second connecting device (connecting device) 500 includes a second housing (housing) 800, a plurality of spring connectors 100, a second electrical connector (electrical connector) 900, a plurality of electrical wire assemblies 200 and a plurality of circuit boards 300. The spring connectors 100 of the second connecting device 500 are stacked on each other and disposed in the second housing 800. The circuit boards 300 and the second electrical connector 900 of the second connecting device 500 are disposed in the second housing 800, and the circuit boards 300 are electrically connected to the second electrical connector 900, such that the electrical wires 201 of the electrical wire assemblies 200 are capable of being electrically connected to the circuit boards 300 and the second electrical connector 900 through the spring terminals 2 of the spring connectors 100. The configuration of the second electrical connector 900 is not limited, and will not be reiterated herein. When the first connecting device 400 and the second connecting device 500 are plugged into each other, the first electrical connector 700 and the second electrical connector 900 can be in contact with each other to achieve an electrical connection.

Moreover, in an embodiment of the present disclosure, a method for managing electrical wires is also provided. The method for managing electrical wires includes steps of: providing an electrical wire assembly 200 and a spring connector 100 (the configurations of the electrical wire assembly 200 and the spring connector 100 are described in the above embodiments, and therefore will not be reiterated herein); putting the connection portions 202 of the electrical wires 201 of the electrical wire assembly 200 respectively into the wire grooves 11 of the insulating body 1; and then respectively clamping the connection portions 202 of the electrical wires 201 through the contact portions 21 of the spring terminals 2 to enable the connection portions 202 of the electrical wires 201 to be respectively clamped in the gaps 211 of the contact portions 21 of the spring terminals 2. Accordingly, the electrical wires 201 are respectively and electrically connected to the spring terminals 2, and the electrical wire assembly 200 can be managed via the opening 19 of the insulating body 1.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An electrical wire management device, comprising:

an electrical wire assembly including a plurality of electrical wires;

wherein an end of each of the electrical wires has a connection portion; and a spring connector including an insulating body and a plurality of spring terminals; wherein the insulating body is in an arc shape, a side of the insulating body forms an opening, the insulating body has a plurality of wire grooves spaced apart from each other, and the spring terminals are disposed on the insulating body; wherein each of the spring terminals has a contact portion and a pin portion, the contact portion extends in a spiral shape, the contact portion forms a gap, and the pin portion is connected to the contact portion; wherein the contact portions of the spring terminals respectively extend into the wire grooves;

wherein the connection portions of the electrical wires are respectively disposed into the wire grooves of the insulating body, the contact portions of the spring terminals are configured to respectively clamp the connection portions of the electrical wires, and the connection portions of the electrical wires are respectively clamped in the gaps of the contact portions of the spring terminals, such that the electrical wires are respectively and electrically connected to the spring terminals, and the electrical wire assembly is capable of being managed via the opening of the insulating body.

2. The electrical wire management device according to claim 1, wherein the insulating body further has a first end face, a second end face, an inner face and an outer face, the first end face and the second end face are respectively two opposite faces of the insulating body, the inner face and the outer face are respectively located on an inner side and an outer side of the insulating body, the opening extends through the first end face and the second end face of the insulating body, and the inner face surrounds the opening.

3. The electrical wire management device according to claim 1, wherein the pin portions of the spring terminals are electrically connected to a circuit board, the spring connector further includes a cover plate and a support plate; the insulating body further has a plurality of terminal grooves spaced apart from each other, the terminal grooves are respectively in spatial communication with the wire grooves, the spring terminals are respectively accommodated in the terminal grooves, the cover plate is covered on the insulating body for closing the terminal grooves, the circuit board is sandwiched between the cover plate and the insulating body, and the support plate is covered on a face of the cover plate away from the insulating body.

4. The electrical wire management device according to claim 1, wherein the connection portion of each of the electrical wires and the contact portion of the corresponding spring terminal are configured to form four contact points therebetween.

5. An electrical wire management device, comprising:

a housing;

a plurality of spring connectors stacked on each other and disposed in the housing; wherein each of the spring connectors includes an insulating body and a plurality of spring terminals, the insulating body is in an arc shape, a side of the insulating body forms an opening, the insulating body has a plurality of wire grooves spaced apart from each other, and the spring terminals are disposed on the insulating body; wherein each of the spring terminals has a contact portion and a pin portion, the contact portion extends in a spiral shape, the contact portion forms a gap, and the pin portion is connected to the contact portion; wherein in each of the spring connectors, the contact portions of the spring terminals respectively extend into the wire grooves;

an electrical connector disposed in the housing;

a plurality of electrical wire assemblies each including a plurality of electrical wires, and an end of each of the electrical wires having a connection portion; wherein the connection portions of the electrical wires of the electrical wire assemblies are respectively disposed into the wire grooves of the insulating bodies of the spring connectors, the contact portions of the spring terminals are configured to respectively clamp the connection portions of the electrical wires, and the connection portions of the electrical wires are respectively clamped in the gaps of the contact portions of the spring terminals, such that the electrical wires are respectively and electrically connected to the spring terminals; and a plurality of circuit boards disposed in the housing; wherein the pin portions of the spring terminals are respectively and electrically connected to the circuit boards, the circuit boards are electrically connected to the electrical connector, such that the electrical wires of the electrical wire assemblies are capable of being electrically connected to the circuit boards and the electrical connector through the spring terminals of the spring connectors, and the electrical wire assemblies are capable of being managed via the openings of the insulating bodies.

6. The electrical wire management device according to claim 5, wherein the insulating body of each of the spring connectors further has a first end face, a second end face, an inner face and an outer face, the first end face and the second end face are respectively two opposite faces of the insulating body, the inner face and the outer face are respectively located on an inner side and an outer side of the insulating body, the opening extends through the first end face and the second end face of the insulating body, and the inner face surrounds the opening.

7. The electrical wire management device according to claim 5, wherein each of the spring connectors further includes a cover plate and a support plate; wherein in each of the spring connectors, the insulating body further has a plurality of terminal grooves spaced apart from each other; the terminal grooves are respectively in spatial communication with the wire grooves, the spring terminals are respectively accommodated in the terminal grooves, the cover plate is covered on the insulating body for closing the terminal grooves, at least one circuit board of the circuit boards is sandwiched between the cover plate and the insulating body, and the support plate is covered on a face of the cover plate away from the insulating body.

8. The electrical wire management device according to claim 5, wherein in each of the spring connectors and the corresponding electrical wire assembly, the insulating body of the spring connector is in a C-shape, and the electrical wires of the electrical wire assembly are capable of being separated and lined at a center portion of the insulating body such that the electrical wires are capable of being radially arranged with equal lengths; wherein the electrical wires are capable of passing through the center portion of the insulating body such that the insulating body is capable of being stacked on other ones of the insulating body such that a plurality of insulating bodies are stacked on each other.

9. The electrical wire management device according to claim 5, wherein the connection portion of each of the electrical wires and the contact portion of the corresponding spring terminal are configured to form four contact points therebetween.

10. A method for managing electrical wire, comprising:

providing an electrical wire assembly and a spring connector; wherein the electrical wire assembly includes a plurality of electrical wires, and an end of each of the electrical wires has a connection portion; wherein the spring connector includes an insulating body and a plurality of spring terminals, the insulating body is in an arc shape, a side of the insulating body forms an opening, the insulating body has a plurality of wire grooves spaced apart from each other, and the spring terminals are disposed on the insulating body; wherein each of the spring terminals has a contact portion and a pin portion, the contact portion extends in a spiral shape, the contact portion forms a gap, and the pin portion is connected to the contact portion; wherein the contact portions of the spring terminals respectively extend into the wire grooves; and putting the connection portions of the electrical wires respectively into the wire grooves of the insulating body, and then respectively clamping the connection portions of the electrical wires through the contact portions of the spring terminals to enable the connection portions of the electrical wires to be respectively clamped in the gaps of the contact portions of the spring terminals, such that the electrical wires are respectively and electrically connected to the spring terminals, and the electrical wire assembly are capable being managed via the opening of the insulating body.

11. The method for managing electrical wires according to claim 10, wherein the insulating body further has a first end face, a second end face, an inner face and an outer face, the first end face and the second end face are respectively two opposite faces of the insulating body, the inner face and the outer face are respectively located on an inner side and an outer side of the insulating body, the opening extends through the first end face and the second end face of the insulating body, and the inner face surrounds the opening.

12. The method for managing electrical wires according to claim 10, wherein the connection portion of each of the electrical wires and the contact portion of the corresponding spring terminal are configured to form four contact points therebetween.

* * * * *